US007698047B2

(12) United States Patent
Kajiyama et al.

(10) Patent No.: US 7,698,047 B2
(45) Date of Patent: Apr. 13, 2010

(54) ENGINE STOP CONTROL DEVICE

(75) Inventors: Masahiro Kajiyama, Fujisawa (JP); Kazuhiro Mori, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 67 days.

(21) Appl. No.: 12/091,960

(22) PCT Filed: Oct. 26, 2006

(86) PCT No.: PCT/JP2006/321407

§ 371 (c)(1),
(2), (4) Date: Apr. 29, 2008

(87) PCT Pub. No.: WO2007/052532

PCT Pub. Date: May 10, 2007

(65) Prior Publication Data

US 2009/0132150 A1 May 21, 2009

(30) Foreign Application Priority Data

Oct. 31, 2005 (JP) ..... 2005-316821

(51) Int. Cl.
*F02D 29/02* (2006.01)
*F02D 41/30* (2006.01)

(52) U.S. Cl. ..... 701/103; 701/112; 123/179.5

(58) Field of Classification Search ..... 701/103–105, 701/112, 113; 123/349, 179.5
See application file for complete search history.

(56) References Cited

U.S. PATENT DOCUMENTS 3,795,232 A * 3/1974 Snook ..... 123/198 DB
7,281,510 B2 * 10/2007 Kondo ..... 123/179.5

FOREIGN PATENT DOCUMENTS

| | | | |
|---|---|---|---|
| JP | 2001-041072 | | 2/2001 |
| JP | 2001-050079 | | 2/2001 |
| JP | 2001-304005 | | 10/2001 |
| JP | 2002-248935 A | * | 9/2002 |
| JP | 2003-020968 | | 1/2003 |

OTHER PUBLICATIONS

International Search Report for Serial No. PCT/JP2006/321407 dated Dec. 12, 2006.

* cited by examiner

*Primary Examiner*—Hieu T Vo
(74) *Attorney, Agent, or Firm*—McCormick, Paulding & Huber LLP

(57) ABSTRACT

An engine stop control device which is capable of stopping an engine without imparting an unpleasant sensation to the driver is provided. The device includes a fuel injection device for supplying fuel, an intake air amount adjustment device for adjusting an amount of intake air, an accessory controller for controlling operation of an accessory, a fuel injection controller for controlling a fuel injection amount from the fuel injection device, and an engine stop switch. When the engine stop switch is operated, driving of the accessory is stopped by the accessory controller, and the intake air is throttled by the intake air amount adjustment device, and further, when the engine rotational speed rises due to stoppage of the accessory, the engine is stopped while the fuel injection amount of the fuel injection device is controlled by the fuel injection controller such that the engine runs at a predetermined rotational speed.

6 Claims, 3 Drawing Sheets

ENGINE STOP CONTROL DEVICE

CROSS REFERENCE TO RELATED APPLICATIONS

This application is entitled to the benefit of and incorporates by reference essential subject matter disclosed in International Patent Application No. PCT/JP2006/321407 filed on Oct. 26, 2006 and Japanese Patent Application No. 2005-316821 filed Oct. 31, 2005.

TECHNICAL FIELD

The present invention relates to an engine stop control device for performing a stop operation of an engine.

BACKGROUND OF THE INVENTION

Heretofore the following control systems for stopping an engine are known:

(1) The engine is made to stop by cutting fuel to the combustion chamber.

(2) The engine is made to stop by cutting air to the combustion chamber.

(3) The engine is made to stop by cutting both fuel and air to the combustion chamber.

(4) The engine is made to stop by cutting air to the combustion chamber while gradually reducing fuel to the combustion chamber.

Further, in Japanese Laid-Open Patent Publication No. 2001-41072, in an automatic engine stop control, it is proposed to reduce shocks by gradually lowering engine torque.

DISCLOSURE OF THE INVENTION

Notwithstanding, in the engine stop controls of the aforementioned techniques (1) to (4), the following problems have occurred.

In the engine stop control of (1) and (3), because the fuel is cut at the moment that the ignition key is switched from ON to OFF, the engine rotation falls abruptly. As a result of such an abrupt drop-off in engine rotation, vibrations are generated, which impart an unpleasant sensation to the driver.

In the engine stop control of (2) and (4), at the time that the ignition key is turned OFF, an eruption in engine revolution occurs as a result of removal of loads such as the air conditioner and the like. That is, in the case that the air conditioner and other electrical loads and the like are imposed on the engine until just before the ignition key is turned OFF, although the air conditioner and so forth are stopped by turning OFF the ignition key and the engine load is abruptly reduced, the fuel injection amount is not substantially changed. Therefore, fuel is supplied excessively with respect to the engine load and the engine rotation increases suddenly, or stated otherwise, an eruption in engine rotation occurs. Such an eruption also gives a feeling of uneasiness to the driver.

Further, with the automatic stop control of Japanese Laid-Open Patent Publication No. 2001-41072, no type of countermeasure is provided with respect to eruptions caused by electrical resistance (loads) of accessory such as the aforementioned air conditioner and the like. Moreover, because no engine rotation control countermeasures are taken with respect to the time when the intake air is reduced, a large eruption is generated when the accessory is stopped, which gives an unpleasant feeling to the driver.

Consequently, an object of the present invention is to provide an engine stop control device that solves the above problems, and which is capable of performing an engine stop operation without imparting an unpleasant sensation to the driver.

To solve the aforementioned problem, the present invention provides an engine stop control device, including: a fuel injection device for supplying fuel to a combustion chamber of an engine; an intake air amount adjusting device for adjusting an amount of intake air that is supplied to the combustion chamber; accessory control means for controlling operation of accessory(s) that is operated by driving of the engine; fuel injection control means, to which a running condition such as engine rotational speed or the like is input, and which controls a fuel injection amount injected from the aforementioned fuel injection device; and an engine stop switch for carrying out a stop operation of the aforementioned engine. When an engine stop operation is performed by operating the aforementioned engine stop switch, operation of the accessory is stopped by the accessory control means, and the intake air is throttled by the aforementioned intake air amount adjusting device. Moreover, when the engine rotational speed rises due to stoppage of the accessory, the engine is stopped while the fuel injection amount of the fuel injection device is controlled by the fuel injection control means such that the engine runs at a predetermined rotational speed.

Preferably, the fuel injection control means stops fuel injection of the fuel injection device, thereby stopping the engine, after elapse of a predetermined time period from initiation of the engine stop operation.

To solve the aforementioned problem, the present invention provides an engine stop control device, including: a fuel injection device for supplying fuel to a combustion chamber of an engine; an intake air amount adjusting device for adjusting an amount of intake air that is supplied to the combustion chamber; accessory control means for controlling operation of accessory that is operated by driving of the engine; fuel injection control means, to which a running condition such as engine rotational speed or the like is input, and which controls a fuel injection amount injected from the aforementioned fuel injection device; and an engine stop switch for carrying out a stop operation of the aforementioned engine. When an engine stop operation is performed by operating the aforementioned engine stop switch, operation of the accessory is stopped by the accessory control means, and the intake air is throttled by the aforementioned intake air amount adjusting device. Moreover, a target fuel injection amount is calculated by the fuel injection control means such that the engine runs at a target idle rotation speed, and together therewith, when the target fuel injection amount exceeds a predetermined limit value, fuel is injected by the fuel injection device at the limit value, and when the target fuel injection amount does not exceed a predetermined limit value, fuel is injected by the fuel injection device at the target fuel injection amount, so that fuel injection by the fuel injection device is stopped, thereby stopping the engine after elapse of a predetermined time period from initiation of the engine stop operation.

Preferably, the fuel injection control means sets the aforementioned limit value to the fuel injection amount of the fuel injection device at the time of initiation of the engine stop operation.

The fuel injection control means may set the target idle rotation speed to be gradually reduced.

According to the present invention, a superior effect is brought about, in that a stop operation of the engine can be performed without imparting an unpleasant sensation to the driver.

DETAILED DESCRIPTION OF THE PREFERRED EMBODIMENTS

A preferred embodiment of the present invention shall be described in detail below with reference to the accompanying drawings.

The engine stop control device of the present embodiment is applied, for example, to a diesel engine (hereinafter referred to as an engine) of a vehicle.

First, the engine of the present embodiment shall be described with reference to FIG. 1.

Figure 1:
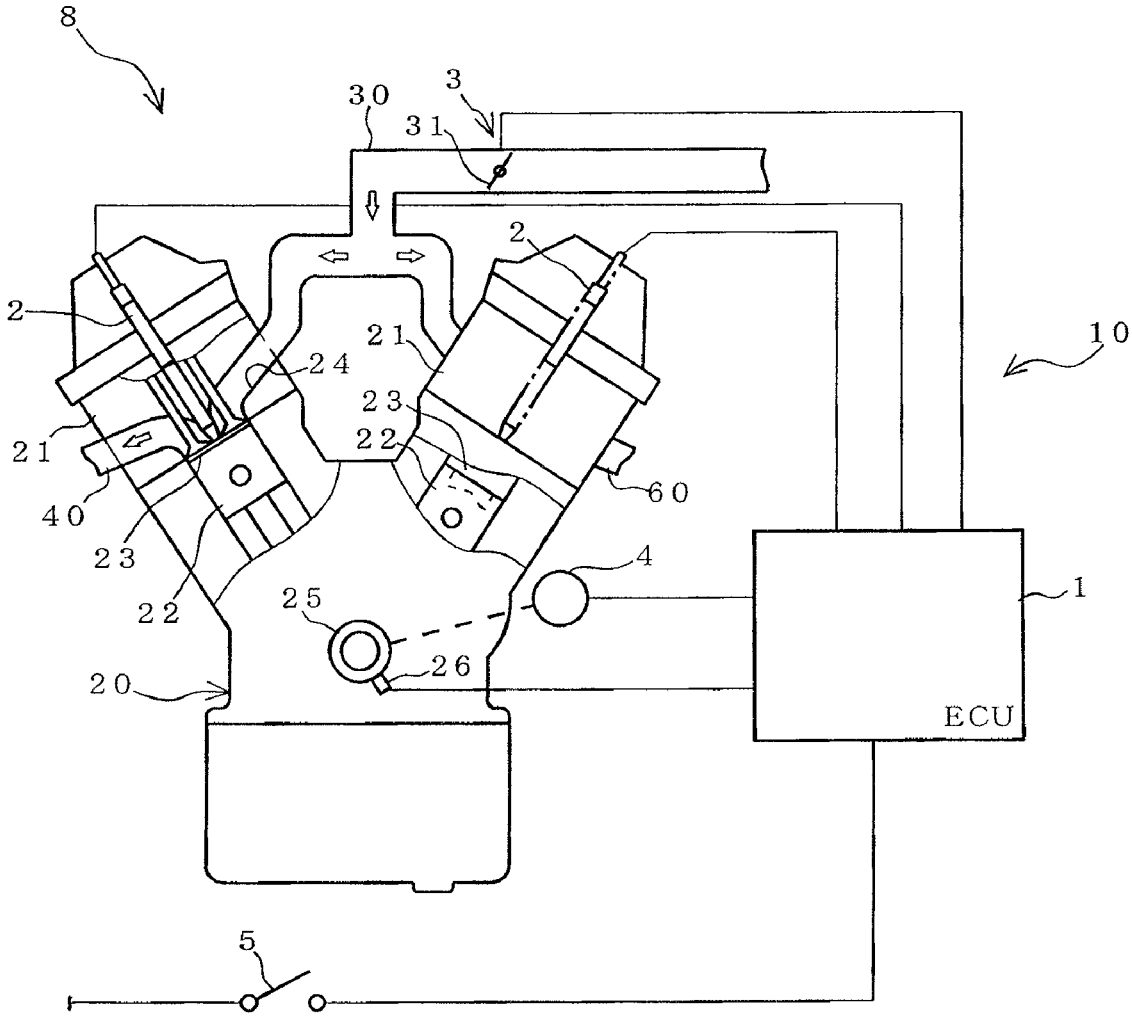
FIG. 1 shows an engine stop control device according to an embodiment of the present invention.

As shown in FIG. 1, the engine 10 is equipped with an engine main body 20, an intake air passage 30 and exhaust passages 40, 60 connected to the engine main body 20, and an ECU (accessory control means, fuel injection control means) 1 for controlling at least the engine main body 20. The ECU 1 may be provided as a single engine control ECU for controlling the engine main body 20, or as a plurality of ECUs, such as a vehicle ECU for performing controls related to the vehicle, and an engine control ECU. In the latter case, it is preferable for the engine control ECU to constitute the fuel injection control means, and the vehicle ECU to make up the accessory control means.

The engine main body 20 is equipped with combustion chambers 23 formed by cylinder heads 21, pistons 22, and the like, and injectors 2 which make up fuel injection devices for supplying fuel to the combustion chambers 23. The injectors 2 are controlled to be opened and closed by the ECU 1. In the open state, fuel is injected into the combustion chambers 23, whereas in the closed state, fuel injection is stopped.

The intake air passage 30 is connected to intake air ports 24 that are formed in the cylinder heads 21 of the engine main body 20 and communicates with the combustion chambers 23 through the intake air ports 24. An intake air amount adjusting device 3, for adjusting the amount of intake air supplied to the combustion chambers 23, is disposed in the intake air passage 30. The intake air amount adjusting device 3 includes an intake air throttle valve 31 disposed in the intake air passage 30, and valve driving means (not shown) which drives opening and closing of the intake air throttle valve 31. The intake air amount of the combustion chambers 23 is adjusted by adjusting the opening degree of the intake air throttle valve 31.

By the aforementioned structure, fuel that is injected by the injectors 2 is combusted in the combustion chambers 23 together with air that is drawn in from the intake air passage 30, whereby the engine 10 is rotated.

Auxiliary equipment 4, which is operated by driving the engine 10, is disposed in the vehicle. The accessory 4, for example, may include an air conditioner, lamps (electrical loads), or the like. The accessory 4 are formed such that operation and stoppage of the accessory 4 can be switched by the ECU 1.

Various types of sensors, such as an engine rotation speed sensor for detecting the rotational speed of the engine 10, are connected to the ECU 1. The engine rotation speed sensor of the present embodiment, for example, is constituted by a crank angle sensor 26, which is attached to the crankshaft 25 of the engine main body 20.

The ECU 1 is connected for outputting control signals to the injectors 2, and controls the fuel injection timing and fuel injection amount and the like of the injectors 2. Specifically, driving conditions, such as the engine rotational speed detected by the crank angle sensor 26, are input to the ECU 1, and based on such driving conditions, the ECU 1 controls the fuel injection amount of the injectors 2. The ECU 1 of the present embodiment carries out a rotation speed control referred to as "idle speed control." The idle speed control is a control for adjusting the fuel injection amount of the injectors 2, so that the engine 10 maintains a predetermined target idle rotation speed. Basically, in the event that the engine rotation speed exceeds the target idle rotation speed, the ECU 1 reduces the fuel injection amount. The idle speed control is carried out, for example, at a time when the accelerator opening is at zero. Generally, the ECU 1 carries out the idle speed control immediately before a stop operation for the engine 10 is performed.

Further, the ECU 1 is connected for outputting a control signal to the valve driving means of the aforementioned intake air amount adjusting device 3, and the intake air throttle valve 31 is controlled to be opened and closed by the valve driving means, whereby the intake air of the combustion chambers 23 is controlled.

The engine stop control device 8 of the present embodiment comprises the aforementioned injectors 2 that supply fuel to the combustion chambers 23 of the engine 10, the intake air amount adjusting device 3 that adjusts the amount of intake air supplied to the combustion chambers 23, the accessory 4 which is operated by driving of the engine 10, the ECU 1, to which driving conditions such as the engine rotational speed, etc., are input, and for controlling the fuel injection amount, and the engine stop switch, which is connected to the ECU 1. The engine stop switch of the present embodiment is constituted by the ignition key 5, which is capable of being selectively turned ON or OFF. When the ignition key 5 is switched from ON to OFF (i.e., when the engine stop switch is operated), the engine stop control device 8 performs an operation for stopping the engine 10 by the ECU 1.

In the present embodiment, when the engine stop operation is carried out by turning the ignition key 5 OFF, the aforementioned ECU 1 stops driving of the accessory 4 together with throttling (limiting) the intake air by the intake air amount adjusting device 3. Further, when the engine rotational speed rises due to stoppage of the accessory 4, the engine 10 is stopped while the fuel injection amount of the injectors 2 is controlled such that the rotational speed of the engine 10, which is detected by the crank angle sensor 26, attains a predetermined rotational speed. More specifically, after elapse of a predetermined time period from initiation of the engine stop operation, the ECU 1 halts the fuel injection of the injectors 2, thereby stopping the engine 10.

In this manner, in the engine stop control device 8 of the present embodiment, because rising of the engine rotational speed is detected and the fuel injection amount is reduced, even when a drop-off in load occurs due to stoppage of the accessory 4, the engine rotational speed does not rise abruptly, and an eruption in engine rotation is prevented.

In the present embodiment, as described in greater detail below, even after the ECU 1 initiates an operation to stop the engine, the aforementioned idle speed control is continuously executed. Moreover, during the idle speed control after initiation of the engine stop operation, the ECU 1 limits the fuel injection amount of the injectors 2 so as to be equal to or less than a predetermined limit value.

More specifically, when an engine stop operation is carried out by turning OFF the ignition key 5, the ECU 1 stops driving of the aforementioned accessory 4 together with throttling the intake air by the intake air adjusting device 3. Moreover, the target fuel injection amount is calculated so that the engine 10 runs at a target idle rotation speed (the aforementioned predetermined rotational speed), such that when the target fuel injection amount exceeds a predetermined limit value, fuel is injected by the injectors 2 at the limit value, and when the target fuel injection amount does not exceed the predetermined limit value, fuel is injected by the injectors 2 at the aforementioned target fuel injection amount. Then, after elapse of a predetermined time period from initiation of the engine stop operation, the fuel injection of the injectors 2 is stopped, thereby stopping the engine 10. In the present embodiment, the ECU 1 sets the aforementioned limit value to the fuel injection amount of the injectors 2 at the time of initiation of the engine stop operation.

Next, an engine stop control method performed by the engine stop control device 8 of the present embodiment shall be described.

First, an outline of the engine stop control method shall be explained.

In the engine stop control method of the present embodiment, when it is intended to stop the engine 10 (specifically, when the ignition key 5 is switched from ON to OFF), air to the combustion chambers 23 is cut by closing the intake air throttle valve 31. Further, within the aforementioned time from turning OFF the ignition key 5, the above-noted idle speed control is made active. Thereby, when the engine rotation starts to erupt as a result of the drop-off in load of the accessory 4, rising of such rotation is suppressed by the idle speed control.

Thereafter, during the idle speed control (inside the predetermined time period), a limitation is imposed on the fuel injection amount of the injectors 2 by the fuel injection amount at the time when the ignition key 5 was turned OFF, and after elapse of the predetermined time period, the fuel injection by the injectors 2 is cut and the engine 10 is stopped. Owing thereto, when the engine rotational speed falls due to cutting of the intake air, even if the fuel injection amount is increased by the idle speed control, the engine 10 can be reliably stopped. Further, even in the case that air cannot be cut by the intake air adjusting device 3, such as at times when the intake air throttle valve 31 is damaged or the like, the engine 10 can still be reliably stopped.

Next, an example of the engine stop control flow process, executed by the engine stop control device 8 of the present embodiment, shall be explained with reference to FIG. 2.

Figure 2:
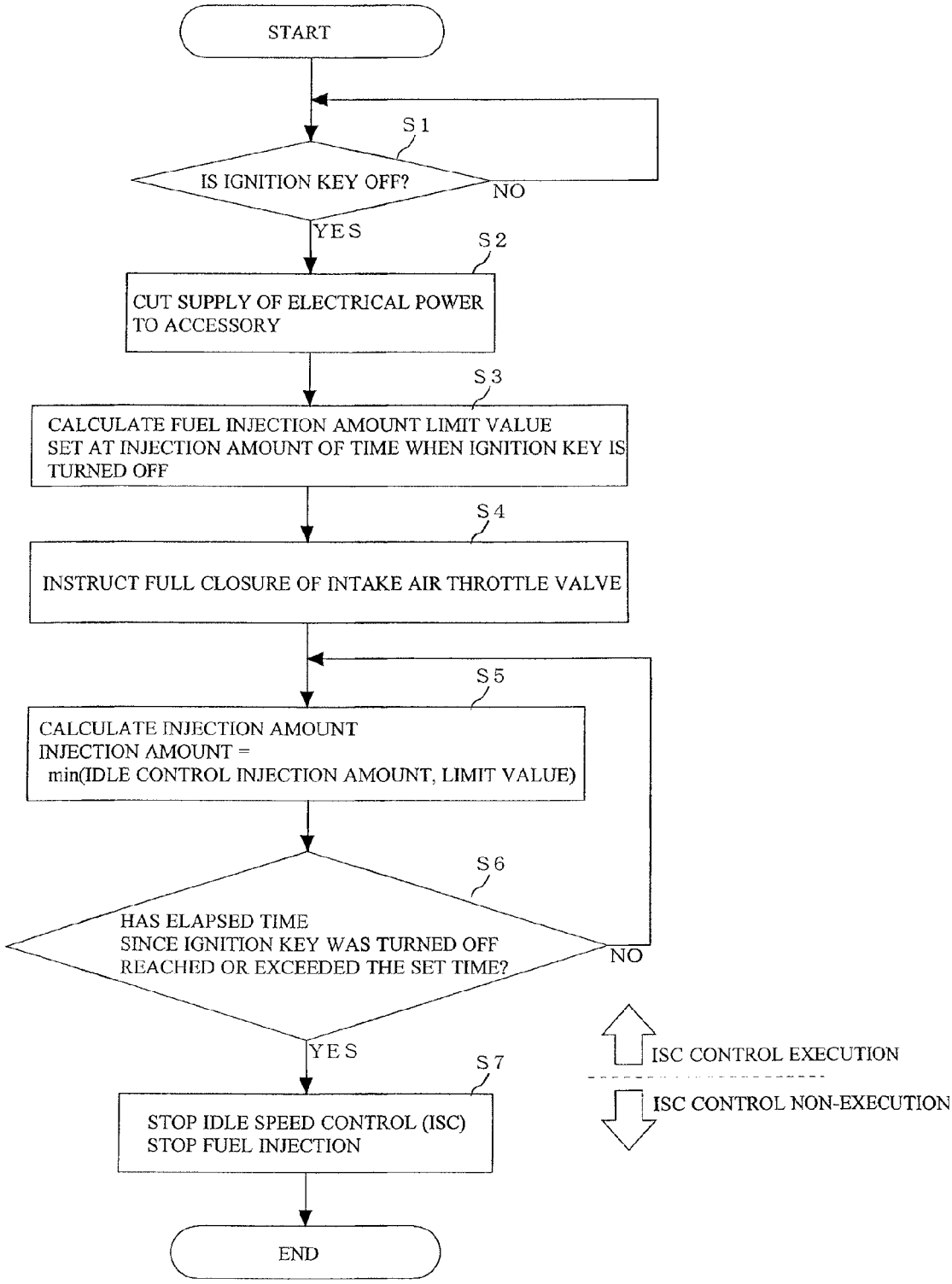
FIG. 2 shows an example of an engine stop control process flow, as performed by the engine stop control device of the present embodiment.

The flow process of FIG. 2 is executed by the ECU 1, for example, at a time when the engine 10 is in an idle state.

In step S1, the ECU 1 determines whether or not the ignition key 5 has been turned OFF. In the case it is judged that the ignition key 5 is OFF in step S1, that is, in the event that the ignition key 5 has been switched from ON to OFF, in step S2 the ECU 1 cuts the supply of electricity (electrical power) to the accessory 4, whereby driving of the accessory 4 is stopped. Stopping of the accessory 4 may also be performed by a vehicle ECU (accessory control means). Further, in the case it is judged that the ignition key 5 is not OFF in step S1 (i.e., that the ignition key 5 remains ON), step S1 is repeated at a given control cycle.

In step S3, the ECU 1 calculates the aforementioned limit value for the fuel injection amount. According to the present embodiment, the ECU 1 sets as the limit value the fuel injection amount of the injectors 2 at the time it is judged that the ignition key 5 has been turned OFF (at a time when the engine stop operation is initiated). For example, the ECU 1 sets the fuel injection amount which has been calculated based on the idle speed control in the control cycle just before branching off to step S2 to the limit value.

In step S4, the ECU 1 instructs the valve driving means of the intake air adjusting device 3 to fully close the intake air throttle valve 31. Herein, intake air is throttled by the intake air throttle valve 31 in order to rapidly settle the combustion of the engine 10. As in the present embodiment, it is preferable for the valve to be fully closed and for intake air to the combustion chambers 23 to be completely interrupted, although the invention is not necessarily limited to this feature.

In step S5, the ECU 1 performs a calculation of the fuel injection amount (hereinafter, an actual fuel injection amount) that is to be actually injected by the injectors 2. Specifically, the ECU 1 compares the target fuel injection amount (in FIG. 2, the IDLE control fuel amount), which is calculated based on the idle speed control so that the engine 10 obtains the target idle rotation speed, with the limit value calculated in step S3, and then sets the smaller of the two to the actual fuel injection amount, so that the injectors 2 inject fuel at the actual fuel injection amount.

In step S6, the ECU 1 determines whether or not a predetermined time period has elapsed from the time (initiation of engine stop operation) it was judged that the ignition key 5 was turned OFF in step S1. The predetermined time, for example, is the time required after complete closure of the intake air throttle valve 31 and until any air (oxygen) remaining in the intake air passage 30 downstream of the intake air throttle valve 31 or in the intake air ports 24 is totally consumed in the combustion chambers 23. The predetermined time is determined in advance through experimentation or the like. In the present embodiment, the predetermined time is 0.5 seconds.

In the case it is judged in step S6 that the predetermined time period from initiation of the engine stop operation has elapsed, then in step S7, the ECU 1 halts the idle speed control together with stopping fuel injection of the injectors 2. By means of this process, the engine 10 is rapidly stopped.

Figure 3:
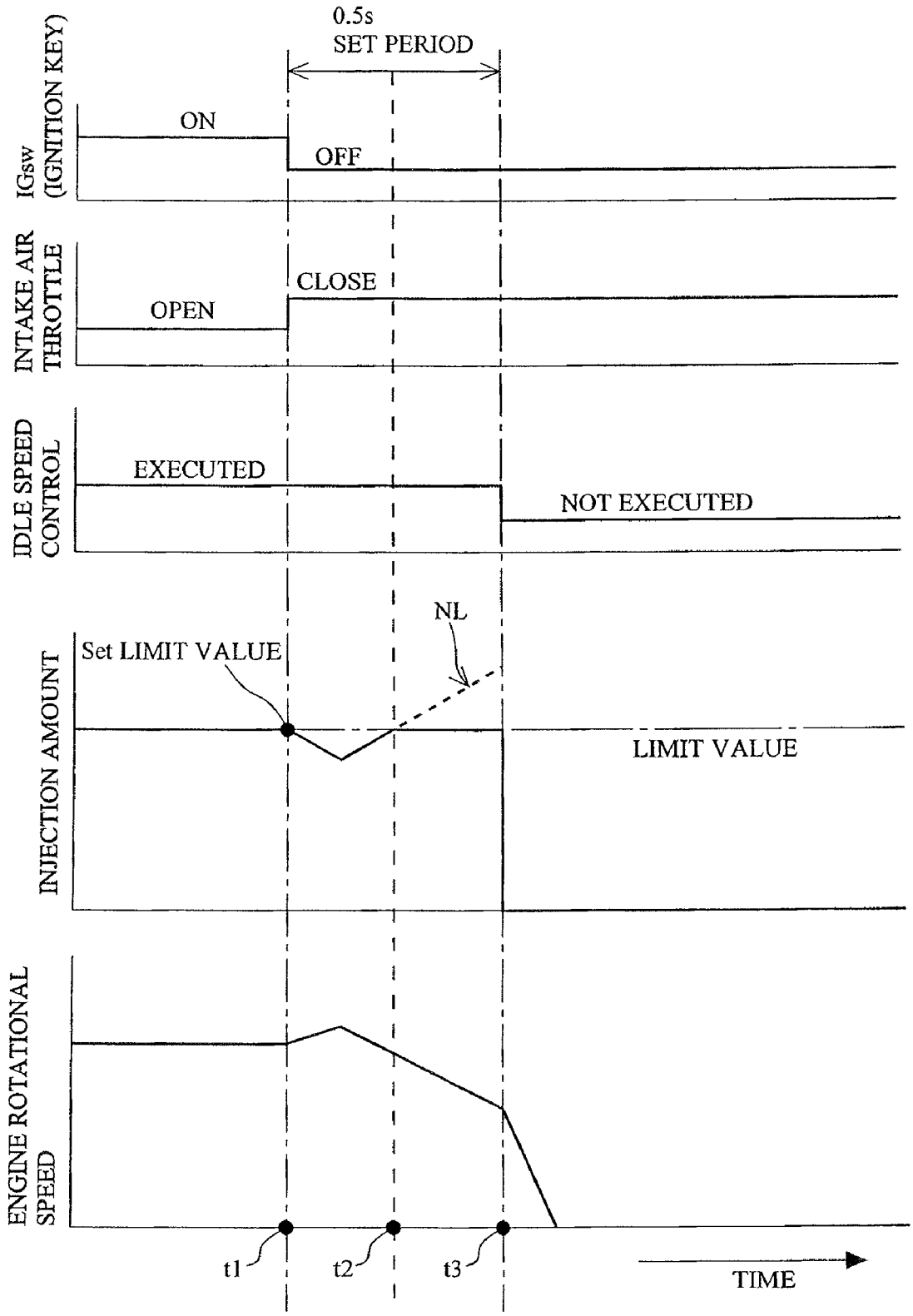
FIG. 3 shows a chart of an engine stop control method, as performed by the engine stop control device of the present embodiment.

Next, details of the engine stop control method of the present embodiment shall be explained with reference to FIG. 3. FIG. 3 shows in succession from the top level thereof the ON-OFF condition of the ignition key 5 (IGsw), the degree of opening of the intake air throttle valve 31, the execution state of the idle speed control, the fuel injection amount, and the engine rotational speed, with time being indicated on the horizontal axis.

Time t0 to time t1 is representative of a condition before the engine stop operation (the ignition key 5 is ON), in which the aforementioned idle speed control is being carried out by the ECU 1, and the fuel injection amount is determined based on the idle speed control.

At time t1, the ignition key 5 is turned OFF by the operator (driver). Accompanying the OFF action, the ECU 1 cuts supply of electricity to the accessory 4. Specifically, extinguishing of lamps and stopping of the air conditioner are carried out. At the same time, the intake air throttle valve 31 is placed in a completely closed condition by the ECU 1, such that the supply of air to the cylinders (combustion chambers 23) is cut.

From time t1 to time t2, because the load on the engine 10 is dropped by stopping driving of the accessory 4, the engine rotational speed becomes higher than the target idle rotation speed. Consequently, while the idle speed control continues to be carried out in the ECU 1, the fuel consumption amount is reduced so that the engine 10 obtains the target idle rotation speed. By reducing the fuel consumption amount, the engine rotational speed is lowered, and rising of the engine rotational speed after stoppage of the accessory is suppressed.

Stated otherwise, because the supply of electricity to the accessory 4 is cut and the resistance generated by the accessory 4 ceases, the rotational speed temporarily rises. However, because the idle speed control is activated, the fuel injection amount is reduced, rising of the rotational speed is suppressed, and the rotational speed is reduced.

From time t2 to time t3, while the temporary rise in engine rotational speed also is suppressed by the idle speed control, soon, the engine 10 falls into an oxygen deprived state due to stoppage of the intake air, and the rotational speed continues gradually to be reduced. When the engine rotational speed is reduced, the ECU 1 attempts to maintain the engine rotational speed due to execution of the idle speed control, and increases the fuel injection amount. However, because a fixed limit value (fuel injection amount at the time the ignition key 5 is turned OFF) exists in the fuel injection amount, a fuel injection amount cannot be performed at or above the limit value. Accordingly, in the case that the fuel injection amount was not limited (as shown by line NL in FIG. 3), fuel would be injected excessively; however, in the present embodiment, excessive fuel injection is prevented.

At time t3, since the predetermined time has lapsed since initiation of the engine stop operation (as described above, the time it takes until the oxygen remaining in the cylinders is totally consumed), the idle speed control of the ECU 1 and the fuel injection (supply) of the injectors 2 is halted, whereby the engine 10 is stopped.

By performing the engine stop control in this manner, while oxygen remains inside the engine 10, the oxygen is not consumed precipitously by an eruption, due to disappearance of the resistance of the accessory 4. Rather, the engine rotational speed is reduced gradually, and it becomes possible for the engine to be stopped quickly in such a way that shocks are reduced.

In this manner, with the engine stop control device 8 of the present embodiment, when the engine 10 is stopped, the engine 10 can be stopped quickly while vibrations and eruptions in engine rotation can be prevented. In other words, eruptions due to disappearance of the resistance of the accessory 4 can be suppressed, and it becomes possible for shocks, which occur upon rapid stoppage of the engine 10 by stopping the supply of fuel, to be buffered. Accordingly, the stop operation for the engine 10 can be performed without imparting an unpleasant sensation to the driver.

Further, by forcibly cutting fuel injection by the injectors 2 after elapse of a predetermined time period, the engine 10 can reliably be stopped.

Further, because eruptions in engine rotation are prevented by continuing the idle speed control, other types of rotational speed controls for preventing eruptions are unnecessary, and the control can be simplified.

The present invention is not limited by the above-described embodiment, and various other modifications and applications thereof may be contemplated.

For example, the control for the accessory need not be performed by an ECU, but rather, the accessory control may be directly interlocked or linked with the ignition key.

For example, the ECU may set the target idle rotation speed so as to be gradually reduced within the idle speed control when the engine stop operation is carried out. For example, during a control cycle in which step S5 and step S6 in FIG. 2 are performed cyclically, the target idle rotation speed at step S5 may be reduced, whereas the target fuel injection amount may be calculated such that the engine rotational speed attains the target idle rotation speed. In this case, rotation of the engine decreases smoothly and the vibration preventative effect of the invention can be heightened.

While the present invention has been illustrated and described with respect to a particular embodiment thereof, it should be appreciated by those of ordinary skill in the art that various modifications to this invention may be made without departing from the spirit and scope of the present invention.

What is claimed is:

1. An engine stop control device, comprising:

a fuel injection device for supplying fuel to a combustion chamber of an engine;

an intake air amount adjusting device for adjusting an amount of intake air that is supplied to said combustion chamber;

accessory control means for controlling operation of an accessory that is operated by driving of said engine;

fuel injection control means for controlling a fuel injection amount injected from said fuel injection device to which a running condition such as engine rotational speed is inputted; and an engine stop switch for carrying out a stop operation of said engine;

wherein, when an engine stop operation is performed by operating said engine stop switch, operation of said accessory is stopped by said accessory control means, and the intake air is throttled by said intake air amount adjusting device; and wherein, when the engine rotational speed rises due to stoppage of said accessory, said engine is stopped while the fuel injection amount of said fuel injection device is controlled by said fuel injection control means such that said engine runs at a predetermined rotational speed.

2. The engine stop control device according to claim 1, wherein said fuel injection control means stops fuel injection of said fuel injection device, thereby stopping said engine, after elapse of a predetermined time period from initiation of the engine stop operation.

3. An engine stop control device, comprising:

a fuel injection device for supplying fuel to a combustion chamber of an engine;

an intake air amount adjusting device for adjusting an amount of intake air that is supplied to said combustion chamber;

accessory control means for controlling operation of an accessory that is operated by driving of said engine;

fuel injection control means for controlling a fuel injection amount injected from said fuel injection device to which a running condition such as engine rotational speed is inputted; and an engine stop switch for carrying out a stop operation of said engine;

wherein, when an engine stop operation is performed by operating said engine stop switch, operation of said accessory is stopped by said accessory control means, and the intake air is throttled by said intake air amount adjusting device; and wherein a target fuel injection amount is calculated by said fuel injection control means such that said engine runs at a target idle rotation speed, and together therewith, when the target fuel injection amount exceeds a predetermined limit value, fuel is injected by said fuel injection device at the limit value, and when said target fuel injection amount does not exceed said predetermined limit value, fuel is injected by said fuel injection device at said target fuel injection amount so that fuel injection of said fuel injection device is stopped, thereby stopping said engine after elapse of a predetermined time period from initiation of the engine stop operation.

4. The engine stop control device according to claim 3, wherein said fuel injection control means sets said limit value to the fuel injection amount of said fuel injection device at the time of initiation of the engine stop operation.

5. The engine stop control device according to claim 4, wherein said fuel injection control means sets said target idle rotation speed to be gradually reduced.

6. The engine stop control device according to claim 3, wherein said fuel injection control means sets said target idle rotation speed to be gradually reduced.

* * * * *